US006629757B1

(12) United States Patent
Sugioka et al.

(10) Patent No.: US 6,629,757 B1
(45) Date of Patent: Oct. 7, 2003

(54) RECORDING HEAD, SUBSTRATE THEREFOR, AND RECORDING APPARATUS

(75) Inventors: Hideyuki Sugioka, Ebina; Haruhiko Koto, Koganei, both of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/586,890

(22) Filed: Jun. 5, 2000

(30) Foreign Application Priority Data

Jul. 2, 1999 (JP) ..... 11-189394
Jun. 7, 1999 (JP) ..... 11-159449

(51) Int. Cl.[7] ..... B41J 2/045; B41J 2/135
(52) U.S. Cl. ..... 347/71; 347/44
(58) Field of Search ..... 347/71, 44, 62, 347/75

(56) References Cited

U.S. PATENT DOCUMENTS 4,782,202 A * 11/1988 Sawae et al. ..... 219/68
6,086,187 A * 7/2000 Hattori et al. ..... 347/63

FOREIGN PATENT DOCUMENTS

| | | |
|---|---|---|
| EP | 0 536 732 A1 | 4/1993 |
| JP | 57-36679 | 2/1982 |
| JP | 57-182451 | 11/1982 |
| JP | 62-201254 | 9/1987 |
| JP | 64-20150 | 1/1989 |
| JP | 64-20151 | 1/1989 |
| JP | 64-20152 | 1/1989 |
| JP | 5-185594 | 7/1993 |
| JP | 5-242793 | 9/1993 |
| JP | 5-301345 | 11/1993 |
| JP | 8-156269 | 6/1996 |

OTHER PUBLICATIONS

English–language abstract of JP 10020208, dated Feb. 20, 1998.

* cited by examiner

*Primary Examiner*—Thinh Nguyen
(74) *Attorney, Agent, or Firm*—Fitzpatrick, Cella, Harper & Scinto

(57) ABSTRACT

A recording head allows overall miniaturization and cost reduction to be implemented and is capable of performing high-quality recording operations. The recording head comprises a plurality of recording elements (heating elements) provided on a base plate, a plurality of metal-insulator-metal (MIM) elements each corresponding to each of the plurality of recording elements and having an insulating layer and a pair of conductive layers sandwiching the insulating layer, first connecting sections provided for individual groups of the plurality of recording elements, and second connecting sections provided for individual groups of the plurality of MIM elements. In this, the first connecting section and the second connecting section are used to perform matrix-driving for each of the plurality of recording elements, thereby performing recording operations. A substrate for the recording head and a recording apparatus are also provided.

29 Claims, 13 Drawing Sheets

RECORDING HEAD, SUBSTRATE THEREFOR, AND RECORDING APPARATUS

BACKGROUND OF THE INVENTION

1. Field of the Invention

The present invention relates to a recording head, a substrate for the recording head, and a recording apparatus.

2. Description of the Related Art

As disclosed in publications, for example, Japanese Unexamined Patent Publication No. 05-185594, it is already known that diodes are provided on a base plate of a recording head, such as a liquid-discharging recording head (ink-jet recording head), and matrix-driving is performed for electrothermal conversion elements (heating elements). Also known is that various items, such as electrothermal conversion elements, shift-register sections, latch sections, and logical circuit sections, are formed on the same base plate.

As a prerequisite, the head mentioned above is formed such that the heating elements, the diodes, and the logical circuits are fabricated on a silicon base plate by semiconductor processing (such as ion-plantation processing). Therefore, it is advantageous that a head with a small number of discharging openings can be produced compactly in a single step. However, for example, in a case where a full-line head that has a line of discharging openings which has a length corresponding to the entire width of a recording sheet is produced by integrally fabricating heating elements, diodes, logical circuits, and the like on the same base plate, the base plate itself must be formed larger in proportion to increase in the length of the head. Even in a case where such a head could be produced, since the head would be very large, it would be highly priced. To avoid this, suggestions have been made such that smaller heads are connected, thereby forming a line head. In this case, however, since variation in the position of the individual heads easily occurs, the overall quality levels of the heads are inconsistent.

SUMMARY OF THE INVENTION

Accordingly, an object of the present invention is to provide a recording head that allows overall miniaturization and cost reduction to be implemented and that is capable of performing high-quality recording operations Another object of the invention is to provide a substrate for the aforementioned recording head.

Still another object of the present invention is to provide a recording apparatus.

To these ends, according to one aspect of the present invention, there is provided a recording head comprising a plurality of recording elements provided on a base plate, a plurality of metal-insulator-metal (MIM) elements each corresponding to each of the plurality of recording elements and having an insulating layer and a pair of conductive layers sandwiching the insulating layer, first connecting sections provided for individual groups of the plurality of recording elements, and second connecting sections provided for individual groups of the plurality of MIM elements, wherein the first connecting section and the second connecting section are used to perform matrix-driving for each of the plurality of recording elements, thereby performing recording operations.

According to another aspect of the present invention, there is provided a substrate for a recording-head comprising a plurality of recording elements provided on a base plate, a plurality of metal-insulator-metal (MIM) elements each corresponding to each of the plurality of recording elements and having an insulating layer and a pair of conductive layers sandwiching the insulating layer, first connecting sections provided for individual groups of the plurality of recording elements, and second connecting sections provided for individual groups of the plurality of MIM elements, wherein the first connecting section and the second connecting section are used to perform matrix-driving for each of the plurality of recording elements, thereby performing recording operations.

According to still another aspect of the present invention, there is provided a recording apparatus comprising a recording head and members for mounting the recording head, the recording head comprising a plurality of recording elements provided on a base plate, a plurality of metal-insulator-metal (MIM) elements each corresponding to each of the plurality of recording elements and having an insulating layer and a pair of conductive layers sandwiching the insulating layer, first connecting sections provided for individual groups of the plurality of recording elements, and second connecting sections provided for individual groups of the plurality of MIM elements, wherein the first connecting section and the second connecting section are used to perform matrix-driving for each of the plurality of recording elements, thereby performing recording operations.

According to the present invention, by forming the plurality of recording elements (heating elements) according to thin-film processing on the base plate at least having the surface which serves as an insulator, the recording head having less variation in characteristics for individual discharging openings can be obtained.

Also, by forming the plurality of MIM elements according to thin-film processing similar to that used for the heating elements, the recording head having less variation in characteristics of the MIM elements can be obtained.

In addition, when electrodes connected to the heating elements and the like are arranged so as to be shared by configuration members of the MIM elements, the number of production steps does not need to be so increased that lower-priced recording head can be obtained.

Furthermore, matrix-driving using the MIM elements is effective for miniaturization of the head and cost reduction therefor.

In the present invention, MIM elements may be formed at cross sections of striped lower electrodes and striped upper electrodes. The MIM elements arranged in a matrix are driven such that voltages are applied to the striped lower electrodes and the striped upper electrodes that are in contact with the MIM elements that will be driven, and the difference between the voltages is applied to the MIM elements. In this case, the potential difference is also applied to the MIM elements only on voltage-applied one of the sides of the striped upper electrodes and the striped lower electrodes. However, the absolute value of the potential difference is lower than that of the potential difference applied to the MIM elements on the both voltage-applied electrodes. In the MIM element, the amount of current variation in response to the variation in an applied potential difference is large. Therefore, even when potential differences having absolute values that are lower than the absolute value of the potential difference for producing a predetermined amount of heat, no substantial current is allowed to flow, and no substantial heat is generated. Thus, the amount of unnecessary heat generated by the MIM element not selected is small.

In this case, voltage-applying means need not be provided for the individual MIM elements provided in a matrix as heating means. Therefore, a configuration can be easily made such that a voltage-applying means for applying voltage to the MIM elements is provided outside of the ink-jet recording head, and interface electrode sections removable from the voltage-applying are provided inside of the ink-jet recording head. That is, end sections of the striped lower electrodes, the striped upper electrodes are arranged on peripheral sections of the ink-jet recording head, and these portions are used as the interface electrode sections that are removable from the voltage-applying means. According to this configuration, production costs for the ink-jet recording head that must be replaced when the ink therein runs short can be reduced.

Further objects, features, and advantages of the present invention will become apparent from the following description of the preferred embodiments with reference to the attached drawings.

DESCRIPTION OF THE PREFERRED EMBODIMENTS

Hereinbelow, the preferred embodiments of the present invention are described.

In this Specification, the term "recording" (which may also be referred to as "printing") of course refers to forming of signified information, such as information represented by characters, graphics, or the like. However, this term also broadly refers either to forming of images, patterns, and the like in a recording medium, or to processing of a recording medium whatever the cases are that the information is formed to be signified or not to be signified, and the information is actually presented so as to be visually recognizable by humans.

Also, in this Specification, the term "recording medium" of course refers to a paper sheet used in ordinary recording apparatuses, and in addition, broadly refers to ink-absorbable materials, such as cloths, plastic films, metal sheets, glass materials, ceramic materials, wooden materials, and leather materials.

The term "ink" (which may also be referred to as "liquid") should also be broadly interpreted, similarly to the term "recording" (or "printing"), as liquid that can be used for forming images, patterns, and the like, for processing of the recording medium and for processing of ink (for example, for making colorants in the ink provided on the recording medium to be solidified or insoluble) when it is provided on the recording medium.

First of all, referring an ink-jet printer as an example, a description will be given of the configuration of a recording apparatus according to an embodiment of the present invention. The recording apparatus performs recording operations by use of a recording head.

Figure 10:
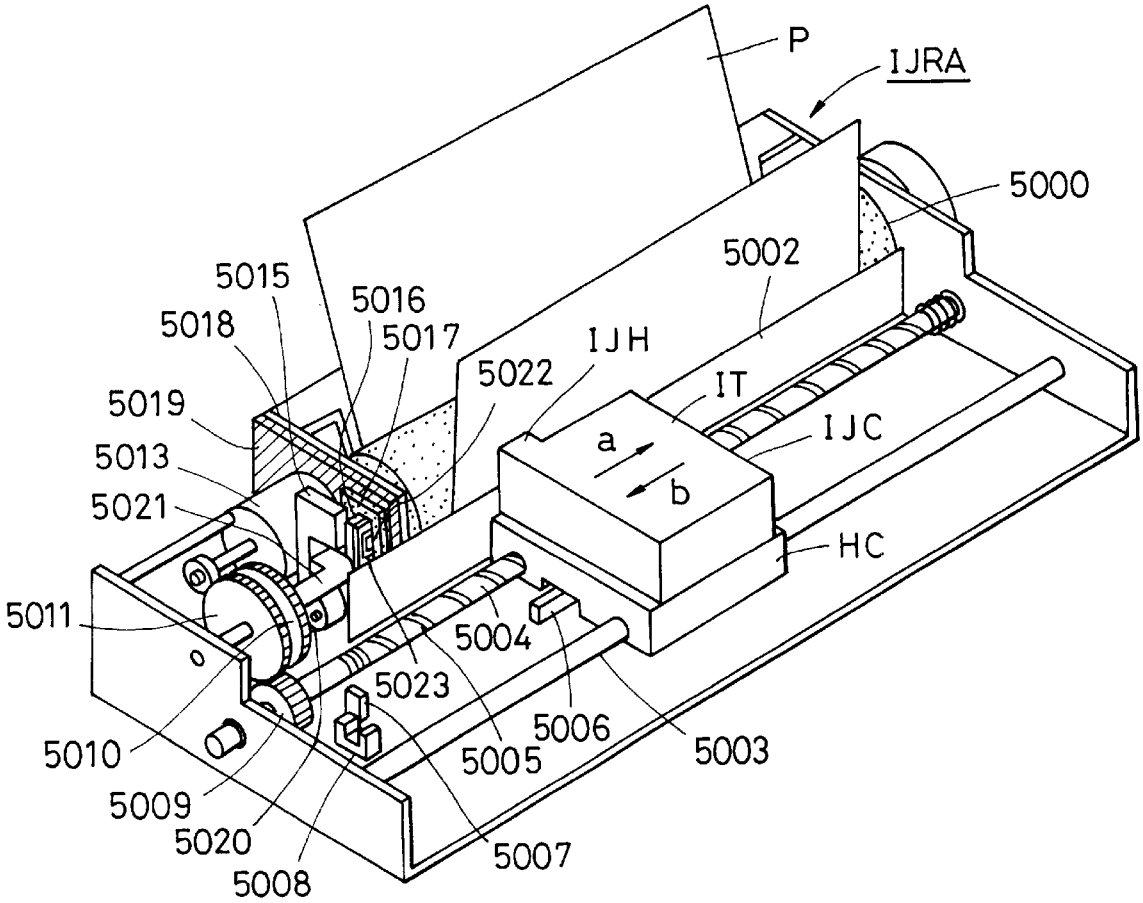
FIG. 10 is a perspective view of major portions of a liquid-discharging apparatus according to the present invention.

FIG. 10 is a perspective view of major portions of an ink-jet printer IJRA according to an embodiment of the present invention. In FIG. 10, a carriage HC has a pin (not shown) that engages with a helical groove 5004 of a lead screw 5005 that rotates according to forward and backward rotation of a driving motor 5013 via driving-force transmission gears 5009 and 5011. By the rotation, the carriage HC supported by a guide rail 5003 moves reciprocatingly in directions indicated by arrows a and b. On the carriage HC, an integrated ink-jet cartridge IJC is mounted. In the ink-jet cartridge IJC, a recording head IJH and an ink tank IT is provided.

A sheet-keeping plate 5002 presses a sheet onto a platen 5000 over the range of movement of the carriage HC. A photocoupler formed of components 5007 and 5008 serves as a home-position detector that detects and verifies the presence of a lever 5006 of the carriage HC to allow operations, such as switching of the rotational direction of the driving motor 5013.

A supporting member 5016 supports a capping member 5022 that caps the front face of the recording head IJH. A drawing-in device 5015 performs a drawing-in operation in the cap, thereby performing drawing-in recovery of the recording head IJH through an opening 5023 of the cap. A cleaning blade 5017 is moved in front and rear directions by a moving member 5019. The cleaning blade 5017 and the moving member 5019 are supported on a supporting board 5018 of the main assembly of the apparatus. For the cleaning blade 5017, a known cleaning blade may of course be used.

A lever 5021 serves to start the drawing-in recovery and moves according to the movement of a cam 5020 engaged with the carriage HC. The driving force from the driving motor is controlled by a known transmitting mechanism, such as a clutch. In the present embodiment, the capping, cleaning, and drawing-in operations can be performed when the carriage HC is moved by the lead screw 5005 and is positioned at the home position. However, the present invention is usable in other arrangement made such that the operations are performed as required with known timing.

Hereinbelow, a description will be given of a circuit configuration provided for controlling the recording apparatus described above.

Figure 11:
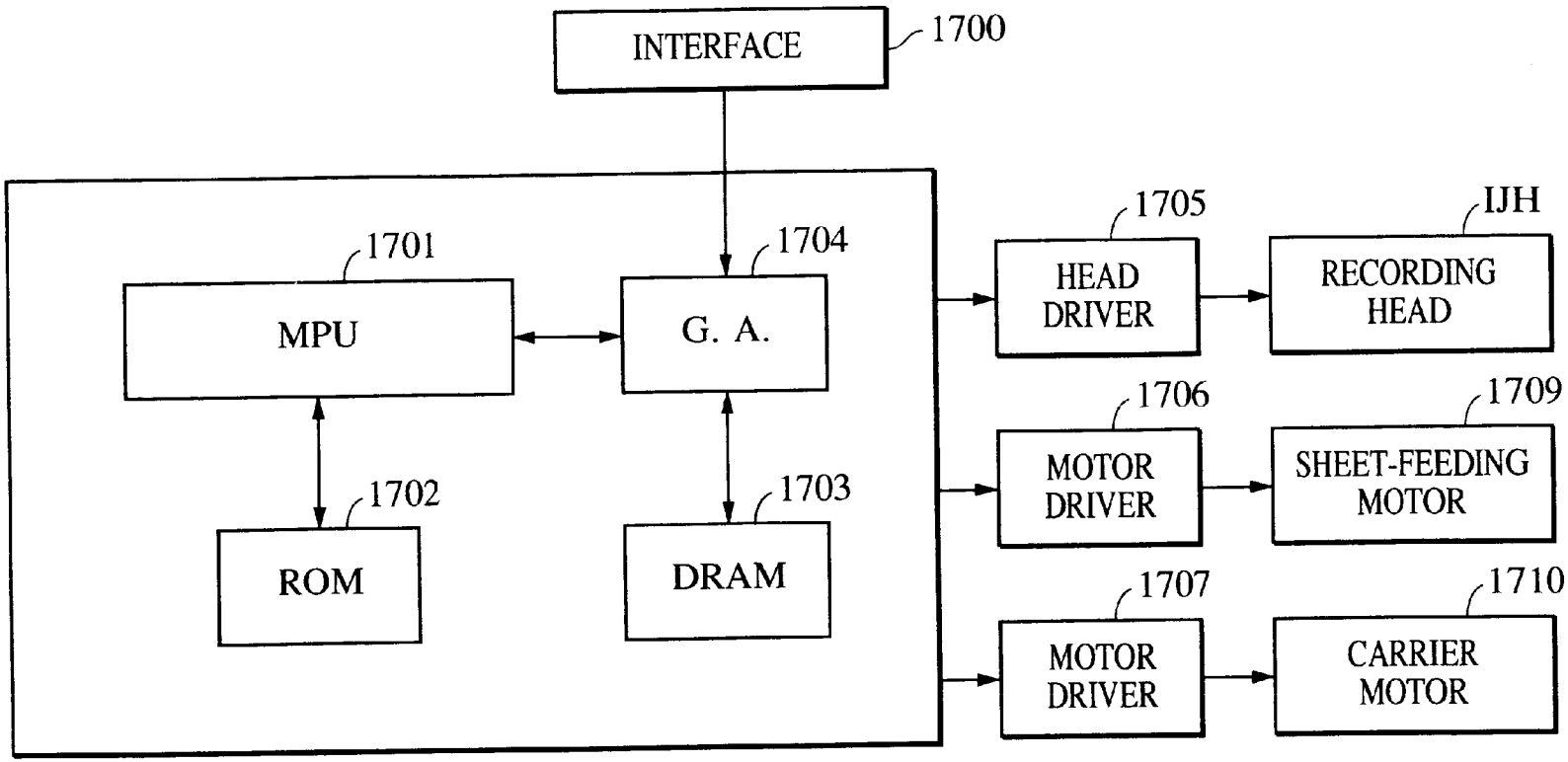
FIG. 11 is a schematic view of a configuration of a control circuit of the ink-jet printer.

FIG. 11 is a schematic view of a configuration of a control circuit of the ink-jet printer IJRA.

The control circuit includes an interface 1700 for inputting recording signals, a microprocessor unit 1701 (MPU), a read-only memory 1702 (ROM) for storing a control program that is executed by the MPU 1701, and a dynamic random access memory 1703 (DRAM) for storing various data (for example, the aforementioned recording signals and recording data that are transferred to the recording head IJH).

The control circuit also includes a gate array 1704 (G.A.), a carrier motor 1710, a sheet-feeding motor 1709, a head driver 1705, and motor drivers 1706 and 1707. The G.A. 1704 controls supply of recording data to the recording head IJH, and also controls transfer of data among the interface 1700, the MPU 1701, and the RAM 1703. The carrier motor 1710 carries the recording head IJH. The sheet-feeding motor 1709 feeds recording sheets. The head driver 1705 drives the recording head IJH. The motor driver 1706 drives the sheet-feeding motor 1709, and the motor driver 1707 drives the carrier motor 1710.

Hereinbelow, a description will be given of control operations of the described control circuit.

When a recording signal is sent to the interface 1700, the recording signal is converted between the G.A. 1704 and the MPU 1701 to recording data. Then, the motor drivers 1706 and 1707 are driven, and concurrently, the recording head IJH is driven according to the recording data transferred to the head driver 1705. Thereby, recording is performed.

In the described configuration, the control program to be executed by the MPU 1701 is stored in the ROM 1702. However, a configuration may be such that an erasable/writable storage medium, such as an electrically erasable programmable read only memory (EEPROM), is added, thereby allowing the control program to be modified from the ink-jet printer IJRA and a host computer connected thereto.

As described above, the ink tank IT and the recording head IJH may be integrally formed to form the replaceable ink-jet cartridge IJC. However, the recording head IJH and the ink tank ink tank IT may be formed so that they can be separated from each other to allow only the ink tank IT to be replaced when ink runs short.

Figure 12:
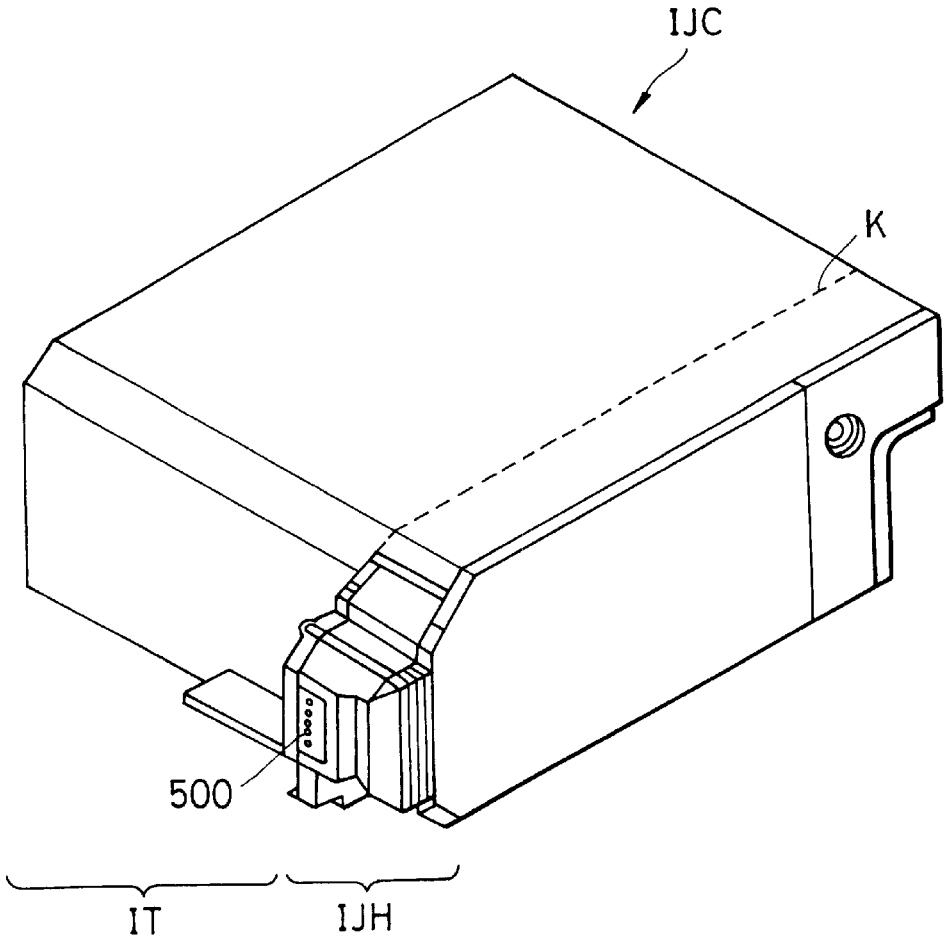
FIG. 12 is a perspective view of an example ink-jet cartridge used in the liquid-discharging apparatus of the present invention.

FIG. 12 is a perspective view of the ink-jet cartridge IJC integrally formed of the ink tank IT and the recording head IJH that can be separated from each other. As shown in FIG. 12, the ink-jet cartridge IJC can be separated along a border line K into the ink tank IT and the recording head IJH. In the ink-jet cartridge IJC with the carriage HC mounted, there is provided electrodes (not shown) for receiving electrical signals. According to the electrical signal, the recording head IJH is driven as described above; then, ink is discharged. In the figure, 500 refers to a line of ink-discharging openings. In addition, the ink tank IT has an ink-absorbing material that is either fibrous or porous.

Hereinbelow, a description will be given of the recording head and a substrate for the recording head according to the present invention.

Figure 1:
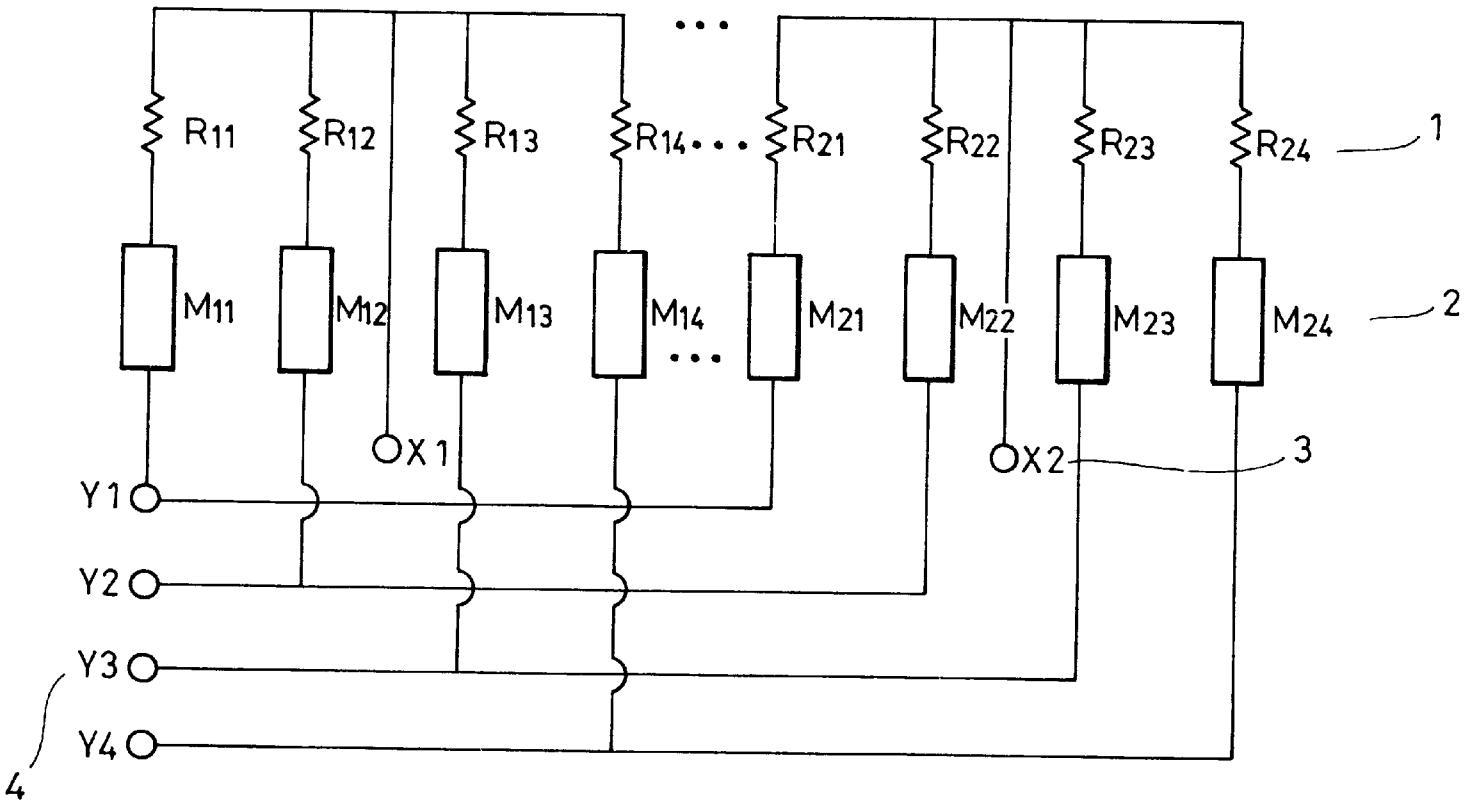
FIG. 1 is a schematic view of an element arrangement of a liquid-discharging head according to an embodiment of the present invention.

FIG. 1 is a schematic view of an element arrangement of a liquid-discharging head according to an embodiment of the present invention. In the figure, heating elements 1, which are recording elements of the present embodiment, represent individual elements such as those shown with reference symbols R11, R12, R23, and R24; and metal-insulator-metal (MIM) elements 2 represent individual MIM elements such as those shown with reference symbols M11, M12, M23, and M24. For a group of R11 to R14 and a group of R21 to R24 of the heating elements 1, first connecting sections 3(X1) and 3(X2) are provided, respectively. For groups of M11 and M21, M12 and M22, M13 and M23, and M14 and M24 of the MIM elements 2, second connecting sections 4(Y1), 4(Y2), 4(Y3), and 4(Y4) are provided, respectively. Thus, the connecting sections corresponding to the connecting sections 3 and 4 are provided. A driving integrated circuit (IC)(not shown in FIG. 1) is arranged; and according to voltage applied from the driving IC, the heating elements 1 are driven via the connecting sections 3 and 4.

Figure 2:
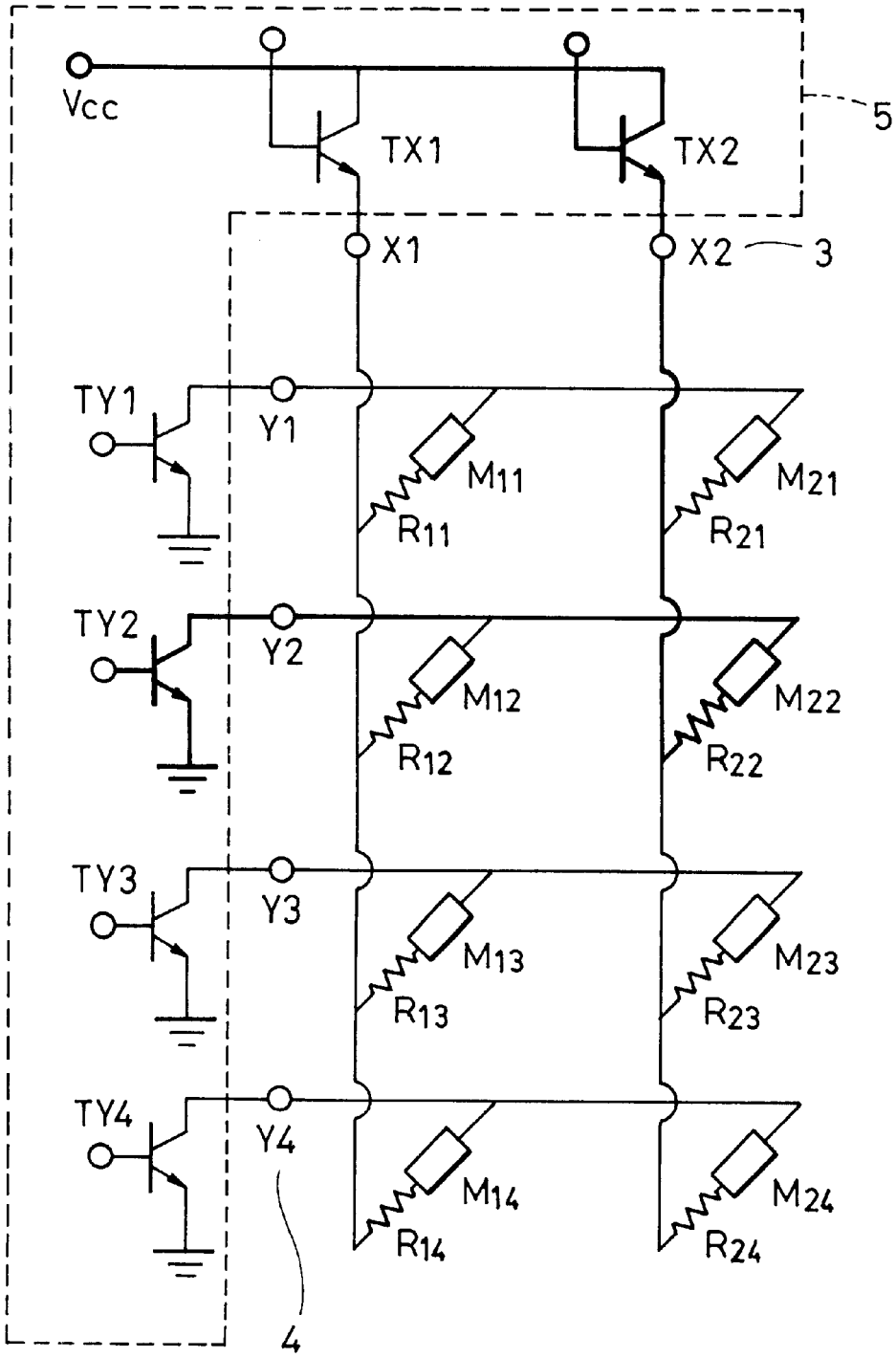
FIG. 2 is a diagram of a circuit including a driving integrated circuit (IC) for driving heating elements shown in FIG. 1.

FIG. 2 is a diagram of a circuit including a driving IC 5 (driving element) connected via the connecting sections 3 and 4.

The driving IC 5 includes output transistors TX1 and TX2 that are connected to the connecting section 3 and output transistors TY1 to TY4 that are connected to the connecting section 4, and the heating elements to heat in the heating elements 1 can be selectively driven. For example, in FIG. 2, when the output transistors TX2 and TY2 are turned ON, as indicated by a bold line, the heating element R22 is driven via the MIM element M22. To other heating elements, because of nonlinear characteristics of the MIM elements serially connected, almost no voltage is applied.

In FIGS. 1 and 2, to simplify the description, examples in which eight heating elements in the heating elements 1 are driven according to 2×4 matrix driving. Generally, according to mxn matrix driving, the number of connecting sections can be reduced, compared to the case where connecting sections are directly provided from all the heating elements. The effectiveness is increased proportionally to the increase in the number of the m's and the n's. However, with the excessively increased m's and the n's, a problem rises in that wiring lengths are increased, thereby reducing the voltage. Also, when the number of the heating elements to be simultaneously driven is increased, capacitances of the output transistors in the driving IC 5 must also be increased accordingly. In addition, the number of the output transistors in the driving IC 5 must also be increased, thereby enlarging the driving IC 5. This is disadvantageous in the yield.

In this connection, as a preferable practical example, an arrangement may be such that 8×31 matrix driving is performed with a single driving IC, and 28 pieces of such driving IC are mounted on a single base plate. In this case, 7,168 heating elements can be driven, and a line head that is somewhat shorter than 12 inches can be made. In this arrangement, the number of output transistors is 1,120 ((8+32)×28). This reduces the transistors to about 16% in number, compared to the case where the transistors are arranged for the individual heating elements.

Also, an arrangement may be such that 16×16 matrix driving is performed with a single driving IC, and 28 pieces of such driving IC are mounted on a single base plate. In this case, 896 heating elements can be driven; thereby, a line head that is somewhat shorter than 12 inches can be obtained. In this case, the output transistors can be reduced to about 13% in number, compared to the case where the transistors are arranged for the individual heating elements. For reference, for 4×64 matrix driving, the output transistors is reduced to 27% in number.

Figure 3:
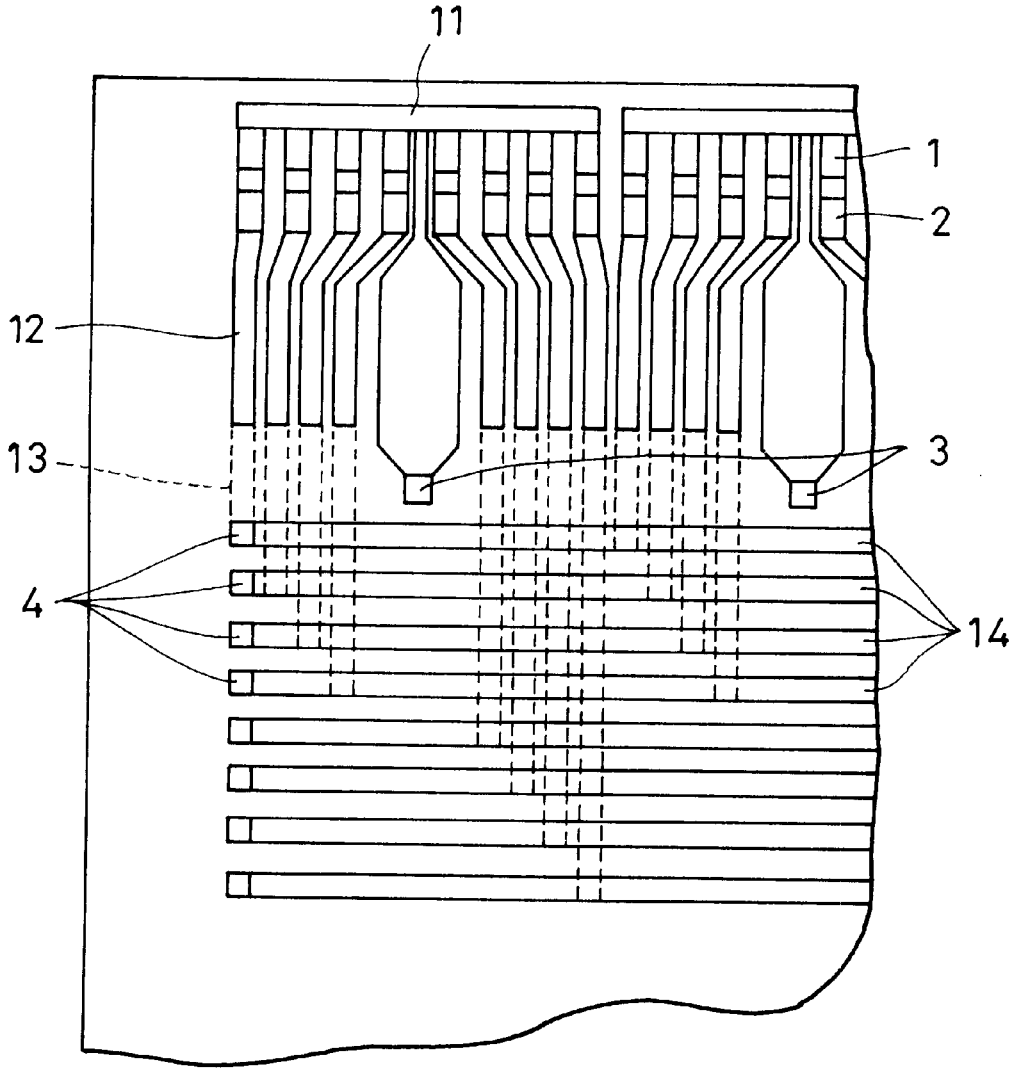
FIG. 3 is a partial top view showing heating elements and electrode wiring patterns arranged on a base plate of a liquid-discharging head according to an embodiment of the present invention.

FIG. 3 is a partial top view showing heating elements and electrode wiring patterns arranged on a base plate of a liquid-discharging head according to an embodiment of the present invention.

As shown in the figure, heating elements 1 are arranged at a high density of 600 dPi on a lengthy base plate at least having an insulated obverse surface. The MIM elements 2 are arranged on the base plate so as to correspond to the heating elements 1.

Common electrodes 11 are provided corresponding to every eight heating elements 1. Each of the common electrodes 11 extends through the middle of the eight heating elements 1 so as to form the letter "T" and is connected to a third connecting section. On the other hand, dedicated wirings 12 individually extend from the MIM elements 2 arranged in the same order as the heating elements 1 grouped for every eight pieces, further extend under individual insulating layers 13, and are connected to individual common electrodes 14. Thus, the dedicated wirings 12 reach a second connecting section 4. Although FIG. 3 shows restricted portions, one driving IC is provided for 32 groups (each group consists of eight heating elements 1 and MIM elements 2). In this embodiment, totally, 7,168 heating elements 1 are provided on the same base plate so as to use 28 pieces of the driving ICs. The connecting section 3 and the second connecting section 4 correspond to one driving IC, and 40 (8+32=40) pieces thereof are provided. Therefore, 1,120 pieces of the connecting sections 3 and the second connecting sections 4 are provided on one base plate.

Figure 4:
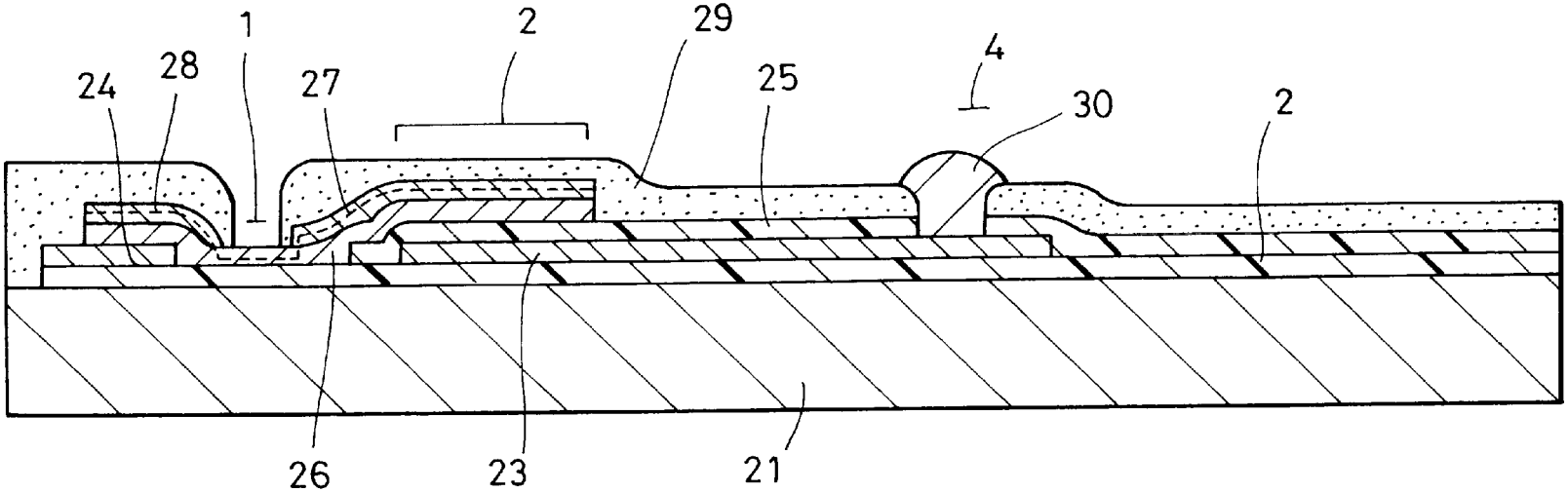
FIG. 4 is a cross-sectional view of a substrate of a liquid discharging head according to an embodiment of the present invention.

FIG. 4 is a cross-sectional view showing a substrate for a liquid-discharging head according to an embodiment of the present invention, which includes the wiring patterns shown in FIG. 3.

An insulating layer 22 made of a silicon dioxide material is layered on the surface of an aluminum base plate 21. The reference symbols 23 and 24 individually denote aluminum wirings, and a part of the aluminum wiring 23 forms a lower metal layer of the MIM element 2. A part of a silicon dioxide layer 25 forms an insulating layer of the MIM element 2. A part of a tantalum-aluminum layer 26 forms the heating element 1, and another part thereof forms an upper metal layer of the MIM element 2. An exposed portion of the tantalum-aluminum layer 26 between aluminum wirings 27 and 28 is used as the heating element 1. The surfaces of aluminum wirings 27 and 28 and the tantalum-aluminum layer 26 are anodic-oxidized, thereby having anti-corrosion characteristics. An organic-passivation film 29 has anti-corrosion characteristics and is applied to coat substantially the entire surface of the liquid-discharging head with the exception of the heating element 1. A bump 30 is electrically connected to the aluminum wiring 23, thereby forming the second connecting section 4.

For forming the films and layers described above, dry-type deposition devices, such as a chemical vapor deposition (CVD) device and a sputtering device, is used as required. Also, for forming the metal films and layers, wet-type deposition devices, such as a plating device, are used. In addition, patterns are formed by using a plasma etching method, a wet-type etching method, and the like.

Figure 5:
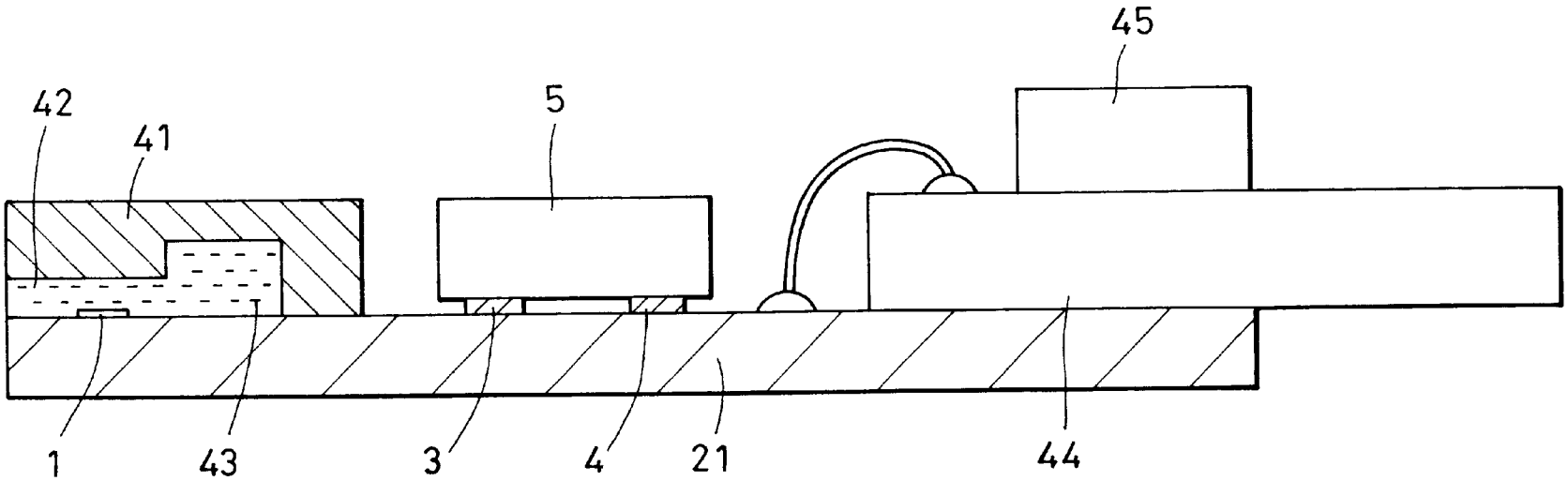
FIG. 5 is a liquid-discharging head according to an embodiment of the present invention.

FIG. 5 is a cross-sectional view showing an example recording head having the substrate for the liquid-discharging head, which is shown in FIG. 4.

An aluminum roof plate 41 is provided so as to cover the heating element 1. Under the roof plate 41, an orifice 42 corresponding to the heating element 1 is provided; that is, a plurality of the orifices 42 corresponding to the individual heating elements 1 is provided. A passage (including the orifice 42) is formed by the roof plate 41, in which ink 43 is filled. The driving IC 5 is connected to the aluminum base plate 21 via the connecting sections 3 and 4. A signal-processing IC 45 is provided on a flexible print circuit (FPC) base plate 44, and a signal. Signals received by an input/output section of the signal-processing IC 45 are sent down to the aluminum base plate 21 via a bonding wire and are inputted to the driving IC 5 via the connecting sections 3 and 4. (It is to be understood that the layers, films, and the like are omitted in FIG. 5).

Hereinbelow, other embodiments of the present invention are described.

Figure 6:
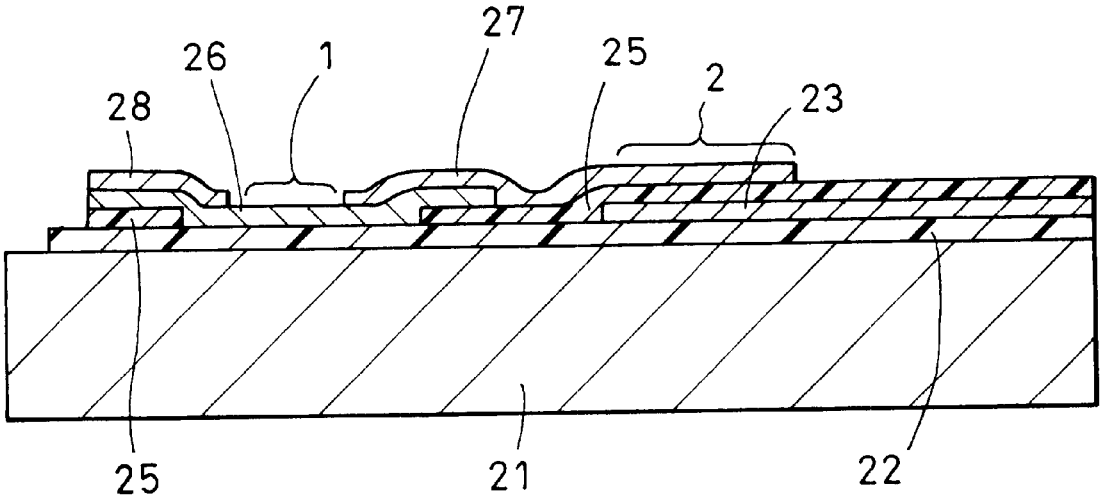
FIG. 6 is a cross-sectional view of a substrate of another liquid-discharging head according to an embodiment of the present invention.

FIG. 6 is a cross-sectional view of a substrate for a liquid-discharging head according to another embodiment of the present invention. The substrate has a film configuration that is different from the film configuration in FIG. 4, as follows.

An upper metal layer of an MIM element 2 is a part of an aluminum wiring 27, and the end on the side opposing the portion used as a part of the MIM element 2 is connected to a tantalum-aluminum layer 26.

As a material for the metal layer of the MIM element 2, for example, one of nickel, chrome, tantalum, tungsten, nickel-chrome, and titanium materials may be used. For insulating layers, for example, one of silicon nitride, oxide silicon nitride, silicon monoxide, zinc oxide, and oxide nitride tantalum materials may be used. These materials are selected in consideration about various factors including anti-corrosion characteristics of the ink.

In this embodiment, the aluminum base plate at least having the insulating layer on the surface. However, instead of the aluminum base plate, a tungsten base plate that has the thermal-expansion coefficient similar to that of the driving IC may be used. Also, insulating non-metal base plate that has an insulating layer on the surface, such as a ceramic base plate or a glass base plate, may be used. Also, with a silicon base plate, since no semiconductor processing is performed, a low-priced head can be produced.

Figure 7:
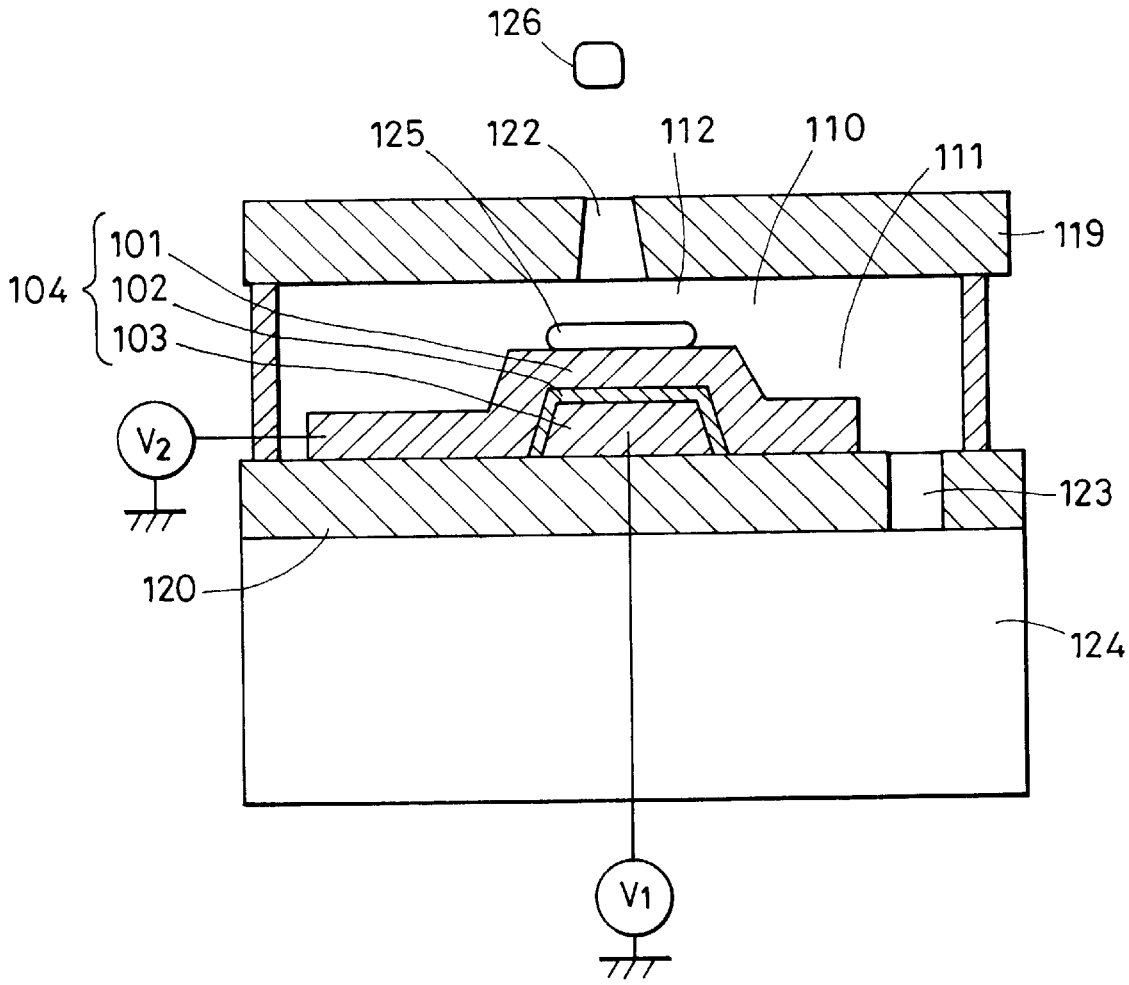
FIG. 7 is a liquid-discharging head according to another embodiment of the present invention.

FIG. 7 is a cross-sectional view showing an ink-jet recording head according to yet another embodiment of the present invention.

As shown in the figure, the ink-jet recording head has a liquid chamber 111, a liquid passage 110, an ink tank 124, and others. The liquid chamber 111 for preserving ink 112 is provided in the vicinity of a discharging opening 122 provided on a base plate 119. The liquid passage 110 allows the liquid chamber 111 and the discharging opening 122 to be communicated. The ink tank 124 reservoirs the ink 112 that is fed to the liquid chamber 111 through an ink-feeding opening 123.

An MIM element 104 is formed on an insulating base plate 120 provided in the liquid chamber 111. The MIM element 104 is a multilayered body consisting of a metal electrode 103 horizontally extending, an insulator 102 layered on the metal electrode 103, and a metal electrode 101 layered on the insulator 102. The metal electrode 103 vertically extending in the figure is made of a metal that has anticavitation characteristics. The MIM element 104 serves as a heating means that heats the ink 112 to bubble. Therefore, the MIM element 104 is provided in the position that opposes the discharging opening 122 provided in the liquid chamber 111.

Hereinbelow, a description will be given of a recording method to be implemented by the described ink-jet recording head.

When voltages $V_1$ *and* $V_2$ are applied to the metal electrode 103 and the metal electrode 101 (having anticavitation characteristics) of the MIM element 104, respectively, thereby generating a potential difference V ($=V_2-V_1$) between the electrodes, a Poole-Frenkel current density I is obtained by the following expressions:

$$I=\alpha V \exp(\beta\sqrt{V}) \quad (1)$$

$$\alpha((n\mu q)/d)\exp(-\phi/(k_B T)) \quad (2)$$

$$\beta=(1/(k_B T))\sqrt{(q^3/(\pi\epsilon_i\epsilon_{0d})} \quad (3)$$

(n: carrier density of the insulator 102; $\mu$: mobility of the carrier; q: charge amount of the carrier; d: thickness of the insulator 102; $\phi$: trap depth; $K_B$: Boltzmann constant; T: temperature; $\epsilon_i$: permittivity of the insulator 102; $\epsilon_0$: vacuum permittivity)

The current I density flows between the electrodes, a power density P (=IV) is used for generating heat, and the ink 112 bubbles (film boiling) according to the heat, thereby generating the bubble 125. In this case, according to increase of the ink 112, an ink droplet 126 discharges from the discharging opening 122 in the direction substantially perpendicular to the base plate 119.

Hereinbelow, a description will be given of a forming method for the MIM element.

For the insulating base plate 120, for example, a glass base plate having a thickness of 1 mm is used. On the glass base plate, first, for example, a Ta metal layer having a width of 40 $\mu$m and a thickness of 0.2 $\mu$m is deposited using a method, such as a sputtering deposition method or a CVD method, thereby forming the metal electrode 103. Then, the metal electrode 103 is anodic-oxidized, thereby forming a metal oxide film having a thickness of 0.05 to 0.1 $\mu$m as the insulator 102. In this case, the anodic oxidation is performed such that a dilute water solution of acids (such as a boric acid, a phosphoric acid, and a tartaric acid) and ammonium salt thereof are used as an electrolytic solution; the ink-feeding opening 123 having the metal electrode 103 is dipped into the electrolytic solution; and electrical-conductivity processing is performed using the metal electrode 103 as an anode. Subsequently, a metal having anticavitation characteristics is deposited so as to cross with the lower metal electrode 103 according to the sputtering method or the like in a width of 40 $\mu$m and a thickness of 0.2 $\mu$m, thereby forming the metal electrode 101. In this way, the MIM element is produced. As described above, for example, the Ta material is used as a material having anticavitation characteristics.

The MIM element 104 has a portion where the bubble 125 is generated, that is, a portion contacting the ink 112, formed of a metal having anticavitation characteristics. In this case, since the MIM element 104 is strong against cavitation, no further anticavitation layer must be formed; thereby allowing the distance between the heating portion and the ink-contacting face to be reduced. In a conventional configuration that uses an anticavitation layer for a heating resistor, an insulating layer must be provided between the anticavitation layer and the heating resistor to electrically insulate them. Thus, in the conventional case, two layers are provided between the heating resistor and the ink. In the case of the MIM element 104 of the present embodiment, however, no insulating layer needs to be used, and only the metal electrode 101 having anticavitation characteristics is provided between the insulator 102 and the ink 112.

The above allows the reduction in the distance between the heating portion and the ink-contacting face. Also, the above improves heat-transferability, thereby allowing the ink 112 to bubble with less power consumption.

In addition, as indicated in the expressions (1) to (3), the amount of heat to be produced by the MIM element 104 relies on the thickness and the material constant of the insulator 102 and does not rely on the resistance value of the metal electrode 101 that has anticavitation characteristics. Therefore, the film thickness of the metal electrode 101 can be sufficiently increased to obtain high anticavitation characteristics.

Figure 8:
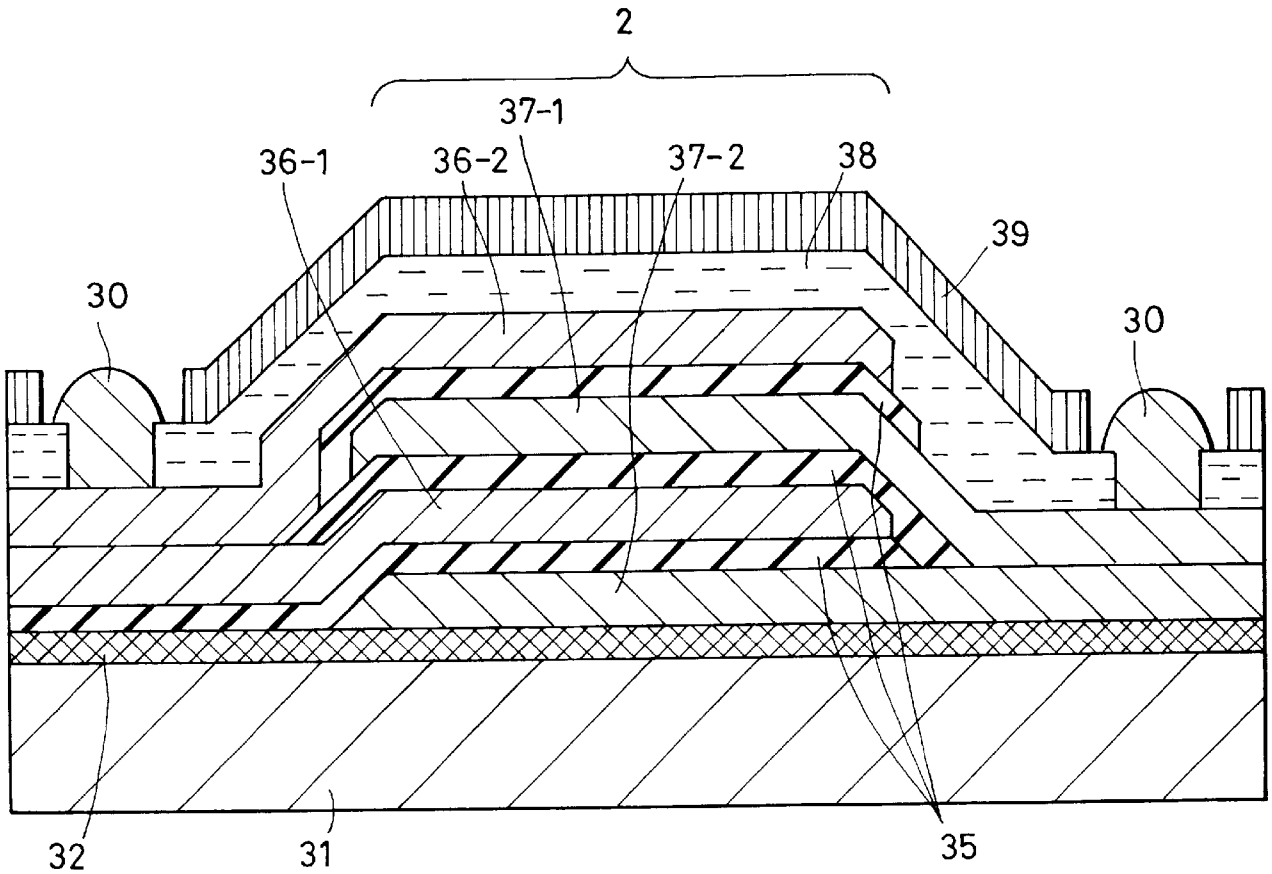
FIG. 8 is a cross-sectional view of a substrate of another liquid-discharging head according to an embodiment of the present invention.

FIG. 8 is a cross-sectional view showing a liquid-discharging head of still another embodiment according to the present invention.

In this embodiment, an MIM element 2 is concurrently used as a heating element. An $SiO_2$ insulating layer 32 is formed on the surface of a silicon base plate 31. SiN insulating layers 35 are individually overlaid between Ta metal layers 36-1 and 36-2 and between metal layers 37-1 and 37-2. Thus, the MIM element 2 is formed with the metal layers 36 (36-1 and 36-2), the metal layers 37 (37-1 and 37-2), and the insulating layers 35 individually overlaid therebetween. In this embodiment, heat is generated by resistance components of the insulating layers 35 and currents flowing, and bubbling of the ink is generated by the heat.

As described above, in the present embodiment, two metal layers 36, two metal layers 37, and three insulating layers 35 are provided. This is intended to increase unit-area energy by overlaying the MIM element 2. In view of the cost, an MIM element with a single layer is advantageous. However, since resistance increases when the film thickness is increased in order to increase the reliability of the insulating layer, it is preferable to form the MIM element with multiple layers. In the present embodiment, three insulating layers 35 are provided; however, the number of layers may be increased as required.

The metal layers 36 and 37 are, respectively, connected to the first connecting section and the second connecting section via bumps 30. On the top, an SiN anticorrosion protection film 38 and a Ta anticavitation protection layer 39 are formed.

According to the present embodiment, since the MIM element 2 is concurrently used as the heating element, the configuration can be simplified, thereby allowing a high-density heating-element configuration to be made. Accordingly, a low-priced highly-integrated lengthy head can be provided. In addition, use of multiple layers for the MIM elements allows a higher-density head to be obtained.

Figure 9A:
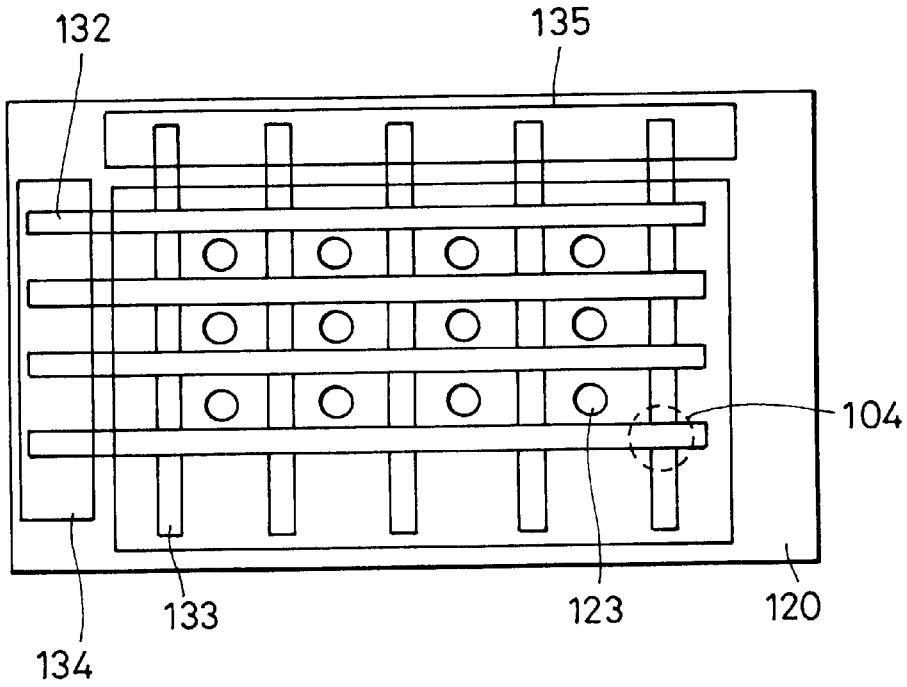
FIGS. 9A and 9B are plan views of a liquid-discharging head according to another embodiment of the present invention.
Figure 9B:
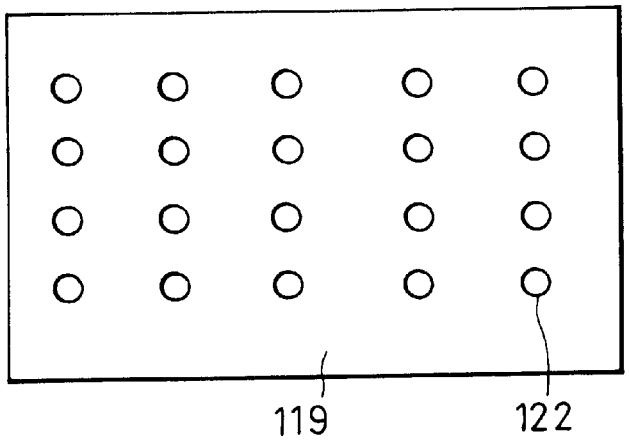

FIGS. 9A and 9B are plan views of an ink-jet recording head of another embodiment according to the present invention. In these figures, the same reference symbols are used for the same portions as those of the precedent embodiments, and descriptions of the same portions are omitted.

As shown in FIG. 9A, a plurality of linear striped lower electrodes 133 and a plurality of linear striped upper electrodes 132 are formed in parallel on an insulating base plate 120 of the ink-jet recording head according to the present embodiment. In the figure, the striped lower electrodes 133 vertically extend, and the striped upper electrodes 132 extend over the striped lower electrodes 133; thus, they are formed in a matrix. In one end section of the striped upper electrodes 132, an interface electrode section 134 is formed; and in one end section of the striped lower electrodes 133, an interface electrode section 135 is formed. The striped lower electrodes 133 are formed by forming an insulator on metal electrodes. The striped upper electrodes 132 are formed of an anticavitation metal. They are configured similarly to the above-described embodiments. MIM elements 104 are formed at cross sections of the striped lower electrodes 133 and the striped upper electrodes 132. Thus, in the present embodiment, the MIM elements 104 are formed in a matrix. In addition, as shown in FIG. 9B, corresponding to the MIM element 104, discharging openings 122 are provided in a matrix on a base plate 119.

Hereinbelow, a description will be given of a method for driving the MIM elements 104 formed in the matrix.

Voltage is selectively applied from a matrix-driving interface of a main printer unit (not shown) to the striped lower electrodes 133 and the striped upper electrodes 132 via the interface electrode section 134 and the interface electrode section 135. In specific, a voltage V1 (<0) is applied to one of the striped lower electrodes 133, and a voltage V2 (>0) is applied to one of the striped upper electrodes 132. Then, the potential difference (V2−V1) is applied to the MIM elements 104 provided at cross sections of the striped lower electrodes 133 to which the voltage V1 has been applied and the striped upper electrodes 132 to which the voltage V2 has been applied. Thereby, the MIM elements 104 are driven. By the MIM elements 104, the ink is heated and caused to bubble, and the ink is allowed to discharge as droplets from corresponding discharging openings 122.

At this time, the potential difference V2 is applied to the MIM elements 104 on the striped upper electrodes 132 to which the voltage V2 has been applied and at cross sections other than the cross sections with the striped lower electrodes 133 to which the voltage V1 has been applied. Similarly, the potential difference −V1 is applied to the MIM elements 104 on the striped lower electrodes 133 to which the voltage V1 has been applied and at cross sections other than the cross sections with the striped lower electrodes 132 to which the voltage V2 has been applied. However, in an MIM element as used for the MIM element 104 of the embodiment, as shown in the expression (1), the amount of current variation in response to the variation in an applied potential difference is large. Therefore, even when the potential difference V2 or −V1 whose absolute value is lower than that of the potential difference (V2−V1) is applied, no substantial current is allowed to flow, and no substantial heat is generated. Thus, according to the present embodiment, the amount of unnecessary heat generated by the MIM element 104 not selected is small.

As described above, in the configuration in which the MIM elements 104 are provided in the matrix as heating means, even in the case where driving circuits are not provided for the individual heating means, the amount of unnecessary heat generated is small. Therefore, as shown in the present embodiment, a configuration can be easily made such that the interface electrode sections 134 and 135 are provided in the peripheral portions of the ink-jet recording head. By the provision of the interface electrode sections 134 and 135, a configuration can be such that the ink-jet recording head can be removable from the driving circuit for the heating means provided in the main printer unit. According to this configuration, the driving means need not be provided in the ink-jet recording head.

The above simplifies the configuration of the ink-jet recording head that must be replaced when ink runs short. Therefore, the ink-jet recording head can be mass-produced at low production costs.

Figure 13:
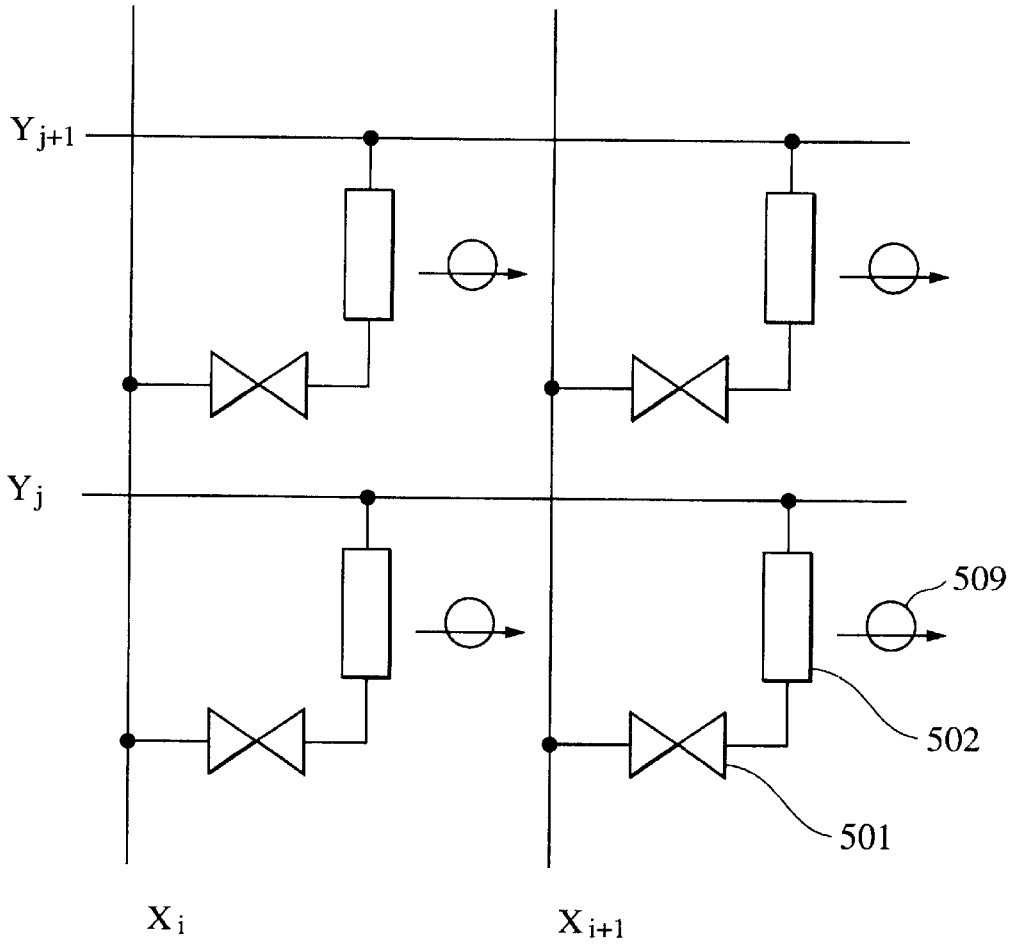
FIG. 13 is a circuit diagram showing an element arrangement in a liquid-discharging head of another embodiment of the present invention.

FIG. 13 is a circuit diagram showing an element arrangement in a liquid-discharging head of an another embodiment according to the present invention. In the figure, 501 denotes MIM elements, 502 denotes piezoelectric elements, and 509 denotes discharged ink droplets. This embodiment is the same as the above-described embodiments except that the piezoelectric elements 502 are used as recording elements.

As above, while the present invention has been described with reference to what are presently considered to be the preferred embodiments, it is to be understood that the invention is not limited to the disclosed embodiments. On the contrary, the invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. A recording head comprising:

a plurality of heating elements provided on a base plate for recording;

a plurality of metal-insulator-metal (MIM) elements each corresponding to each of said plurality of heating elements and each having an insulating layer and a pair of conductors sandwiching said insulating layer;

a first connecting section provided for individual groups of said plurality of heating elements; and a second connecting section provided for individual groups of said plurality of MIM elements, wherein said first connecting section and said second connecting section are used to perform matrix-driving for each of said plurality of heating elements, thereby performing recording operations.

2. The recording head according to claim 1, wherein said plurality of heating elements are a plurality of bubble generating elements for generating a bubble to be utilized to discharge a droplet of liquid by producing film boiling in liquid.

3. The recording head according to claim 1, wherein the recording operations are performed by use of thermal energy generated by said plurality of heating elements.

4. The recording head according to claim 1, wherein said plurality of heating elements are serially connected to said plurality of MIM elements on a one-to-one basis.

5. The recording head according to claim 1, wherein each of said plurality of heating elements is formed by thin-film processing.

6. The recording head according to claim 1, wherein each of said plurality of MIM elements is formed by thin-film processing.

7. The recording head according to claim 6, wherein said base plate is a metal plate having an insulating layer on its surface.

8. The recording head according to claim 6, wherein said base plate is a ceramic base plate having an insulating layer on its surface.

9. The recording head according to claim 6, wherein said base plate is a glass base plate.

10. The recording head according to claim 6, wherein said base plate is a silicon base plate.

11. The recording head according to claim 1, wherein at least a surface of said base plate has insulation characteristics.

12. The recording head according to claim 1, wherein said pair of conductors of each of said plurality of MIM elements concurrently serves as either resistor layers or wiring layers constituting each of said plurality of heating elements.

13. The recording head according to claim 12, wherein said plurality of MIM elements is overlaid.

14. The recording head according to claim 1, wherein each of said plurality of MIM elements concurrently serves as each of said plurality of heating elements, respectively.

15. The recording head according to claim 1, wherein each of said pair of conductors comprises a first conductor and a second conductor sandwiching said respective insulating layer, wherein said first conductor includes a first region which contacts said respective insulating layer, and a first position which excludes said first region and which is provided with a potential, and said second conductor includes a second region which contacts said respective insulating layer, and a second position which excludes said second region and which is provided with a potential, wherein said first region has a first part which is electrically proximal to said first position, and said second region has a second part which is electrically proximal to said second position, and wherein said first part and said second part protrude from a projected surface in a direction of a thickness of said respective insulating layer.

16. The recording head according to claim 15, wherein said MIM elements are rectangular and therein said first part and said second part are parts which respectively correspond to facing edges of said rectangular MIM elements.

17. The recording head according to claim 15, wherein said MIM elements are striped and therein said first part and said second part are included in parts which respectively correspond to both ends of said striped MIM elements.

18. The recording head according to claim 15, wherein said first conductors and said second conductors are striped conductors.

19. The recording head according to claim 15, wherein said first conductors and said second conductors are rectangular striped conductors.

20. A substrate for a recording-head comprising:

a plurality of heating elements provided on a base plate for recording;

a plurality of metal-insulator-metal (MIM) elements each corresponding to each of said plurality of heating elements and each having an insulating layer and a pair of conductors sandwiching said insulating layer;

a first connecting section provided for individual groups of said plurality of heating elements; and a second connecting section provided for individual groups of said plurality of MIM elements, wherein said first connecting section and said second connecting section are used to perform matrix-driving for each of said plurality of heating elements, thereby performing recording operations.

21. A recording apparatus comprising a recording head and members for mounting said recording head, said recording head comprising:

a plurality of heating elements provided on a base plate for recording:

a plurality of metal-insulator-metal (MIM) elements each corresponding to each of said plurality of heating elements and each having an insulating layer and a pair of conductors sandwiching said insulating layer;

a first connecting section provided for individual groups of said plurality of heating elements; and a second connecting section provided for individual groups of said plurality of MIM elements, wherein said first connecting section and said second connecting section are used to perform matrix-driving for each of said plurality of heating elements, thereby performing recording operations.

22. A recording head comprising:

a recording element; and a metal-insulator-metal (MIM) element corresponding to said recording clement and having an insulating layer and a pair of conductors comprising a first conductor and a second conductor sandwiching said insulating layer, wherein said first conductor includes a first region which contacts said insulating layer, and a first position which excludes said first region and which is provided with a potential, and said second conductor includes a second region which contacts said insulating layer, and a second position which excludes said second region and which is provided with a potential, wherein said first region has a first part which is electrically proximal to said first position, and said second region has a second part which is electrically proximal to said second position, and wherein said first part and said second part are offset from each other in a direction of a thickness of said insulating layer.

23. The recording head according to claim 22, wherein said MIM elements are rectangular and therein said first part and said second part are parts which respectively correspond to facing edges of said rectangular MIM elements.

24. The recording head according to claim 22, wherein said MIM elements are striped and therein said first part and said second part are included in parts which respectively correspond to both ends of said striped MIM elements.

25. The recording head according to claim 22, wherein said first conductor and said second conductor are striped conductors.

26. The recording head according to claim 22, wherein said first conductor and said second conductor are rectangular striped conductors.

27. The recording head according to claim 22, wherein either said first conductor or said second conductor concurrently serves as either said recording element or a wiring electrically connected to said recording element.

28. The recording head according to claim 22, wherein said MIM element concurrently serves as either said recording element or a wiring electrically connected to said recording element.

29. A recording head comprising:

a plurality of heating elements for recording;

a plurality of metal-insulator-metal (MIM) elements respectively located separately each corresponding to each of said plurality of heating elements and each having an insulating layer, and each having a first conductor and a second conductor sandwiching said insulating layer;

a plurality of first wirings electrically connected to said MIM elements through said first conductors; and a plurality of second wirings electrically connected to said MIM elements through said second conductors, wherein each of said plurality of first wirings is connected with said plurality of second wirings through plural MIM elements selected from said plurality of MIM elements, and wherein each of said heating elements can be driven individually by supplying voltage to a first wiring selected from said first wirings and a second wiring selected from said second wirings.

* * * * *

UNITED STATES PATENT AND TRADEMARK OFFICE

CERTIFICATE OF CORRECTION

PATENT NO. : 6,629,757 B1 
DATED : October 7, 2003
INVENTOR(S) : Hideyuki Sugioka et al.

It is certified that error appears in the above-identified patent and that said Letters Patent is hereby corrected as shown below:

Column 5,
Line 49, "is" should read -- are --.

Column 8,
Line 62, "$V_{1\ \text{and}\ v2}$," should read -- $V_1$ and $V_2$ --.

Column 9,

Line 4, "$\sqrt{q^{3/\pi\varepsilon_i\varepsilon_{0d)}}}$" should read --$\sqrt{q^3/(\pi\varepsilon_i\varepsilon_0 d)}$--.

Column 12,
Line 62, "each of said pair" should read -- each of said pairs --.

Column 14,
Line 2, "clement" should read -- element --.

Signed and Sealed this

Twenty-ninth Day of June, 2004

JON W. DUDAS
*Acting Director of the United States Patent and Trademark Office*